US006786798B1

(12) United States Patent
Gendel

(10) Patent No.: US 6,786,798 B1
(45) Date of Patent: Sep. 7, 2004

(54) ANTIMICROBIAL BRA

(76) Inventor: Kathleen Gendel, 7 Dovecote La., Malvern, PA (US) 19355

( * ) Notice: Subject to any disclaimer, the term of this patent is extended or adjusted under 35 U.S.C. 154(b) by 0 days.

(21) Appl. No.: 10/601,855

(22) Filed: Jun. 24, 2003

Related U.S. Application Data

(60) Provisional application No. 60/456,762, filed on Mar. 21, 2003.

(51) Int. Cl.[7] ..... A41C 3/00

(52) U.S. Cl. ..... 450/1; 450/36; 450/37; 450/54

(58) Field of Search ..... 450/1, 37, 36, 450/39, 40, 54–58, 60, 61, 92, 93; 2/104–106, 113–115, 78, 721–724, 78.1–78.4, 69, 463, 457, 53–56, 109, 110, 243.1, 272, 901, 902

(56) References Cited

U.S. PATENT DOCUMENTS 4,343,853 A * 8/1982 Morrison ..... 442/240
5,882,242 A * 3/1999 Hardy ..... 450/93
5,968,597 A * 10/1999 Vogt et al. ..... 427/377
6,040,393 A * 3/2000 Vogt et al. ..... 525/454
6,451,144 B2 * 9/2002 Williamson et al. ..... 156/148
6,461,386 B1 * 10/2002 Chan et al. ..... 8/115.51
6,488,564 B1 * 12/2002 Gray ..... 450/57
6,499,320 B1 * 12/2002 Bernhardt ..... 66/178 R
6,602,811 B1 * 8/2003 Rock et al. ..... 442/312
6,605,751 B1 * 8/2003 Gibbins et al. ..... 602/41

* cited by examiner

*Primary Examiner*—Gloria M. Hale
(74) *Attorney, Agent, or Firm*—Robert S. Lipton, Esq.; Lipton, Weinberger & Husick

(57) ABSTRACT

The Invention is a brassiere to be worn after breast surgery. The fabric of the brassiere includes antimicrobial fibers that control microbes on the skin of the woman's breast area both before and after surgical incisions are healed. The antimicrobial fiber is a synthetic fiber incorporating a silver sodium hydrogen zirconium phosphate ion exchange resin. The antimicrobial fiber contains silver ions in antimicrobial amounts.

16 Claims, 6 Drawing Sheets

ANTIMICROBIAL BRA

PRIORITY CLAIM

This Application claims the benefit of U.S. Provisional Application No. 60/456,762 filed on Mar. 21, 2003.

FIELD OF THE INVENTION

The invention relates to a brassiere to assist in infection control after breast surgery and to generally control microbes on the skin of a woman's breast area.

BACKGROUND

Breast surgery may be undertaken for any of a number of reasons. A mastectomy (surgical removal of the breast) may be required to remove breast cancer. A biopsy such as an open excisional biopsy (lumpectomy) or needle aspiration may be used to obtain a sample of a suspected tumor for analysis. Mastopexy (breast lift) or breast augmentation may be undertaken for cosmetic reasons. Mammoplasty (breast reduction) may be undertaken for cosmetic reasons or to treat physical symptoms. Reconstructive surgery may restore the contour of a breast after accident or other surgery, or may be used to amend the contour of a healthy breast to match the contour of a breast changed by other surgery. As in all surgeries, surgeries of the breast share the characteristic that an incision or a penetration of the skin overlying the breast is required. As in all surgeries, surgeries of the breast involve a risk that bacteria or other infectious agents may travel through the skin penetration and cause an infection.

The control of microbes on the undergarments of a post-surgery patient, such as a brassiere of a breast surgery patient, helps to reduce infection and to improve the emotional well-being of the patient. A brassiere is worn continuously for many hours, providing a relatively warm, relatively moist environment in which microbes may multiply. The problem posed by microbes is exacerbated in the case of the post-operative breast surgery patient due to the fact that tenderness and loss of arm strength or mobility resulting from the breast surgery may make maintaining a high degree of personal cleanliness difficult for the patient. The control of microbes in the brassiere of a post-breast surgery patient further helps to prevent anxiety and to maintain the emotional well being of the patient by preventing odors or discoloration resulting from the presence of the microbes.

SUMMARY OF THE INVENTION

The Invention is a brassiere for use after breast surgery. Portions of the brassiere that may come in contact with the skin of a woman's breast area include antimicrobial fibers. The antimicrobial fibers are synthetic fibers containing an ion exchange resin incorporating ions of the element silver. The silver in the ion exchange resin acts as a broad spectrum antimicrobial and kills or suppresses the growth of a wide variety of microbes on the skin of the woman's breast area.

When worn by a woman who has undergone breast surgery, the silver in the fibers of the brassiere has an Inhibitory effect on microorganisms present on the skin of the breast area. The Invention thereby reduces the opportunity for infection of incisions in the breast area. The suppression of microorganisms on the skin and in the brassiere further serves to reduce odors and staining of the brassiere caused by microorganisms, improving the woman's sense of well being.

DESCRIPTION OF AN EMBODIMENT

Figure 1:
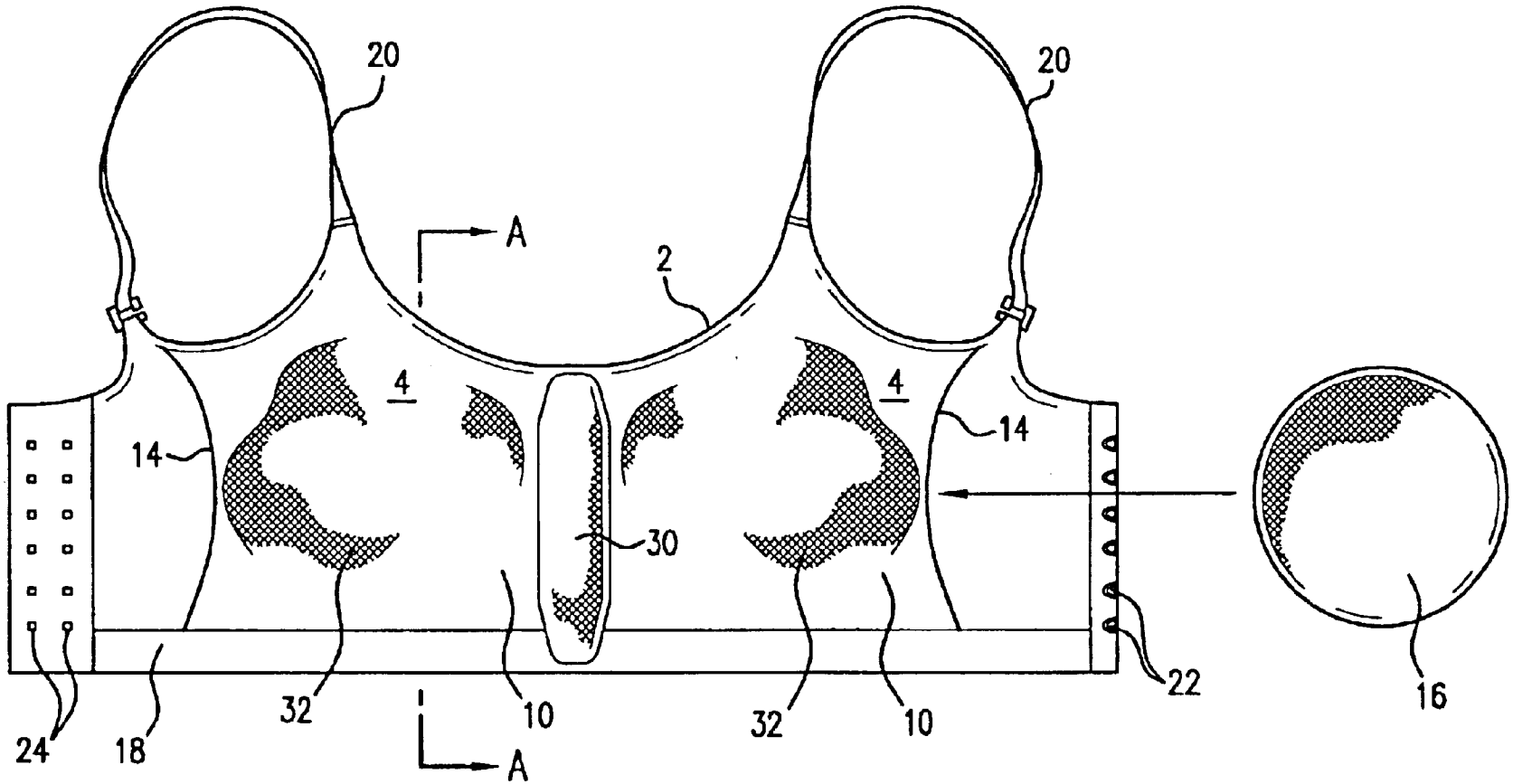
FIG. 1 is a diagram of the inner side of the brassiere of the Invention.
Figure 3:
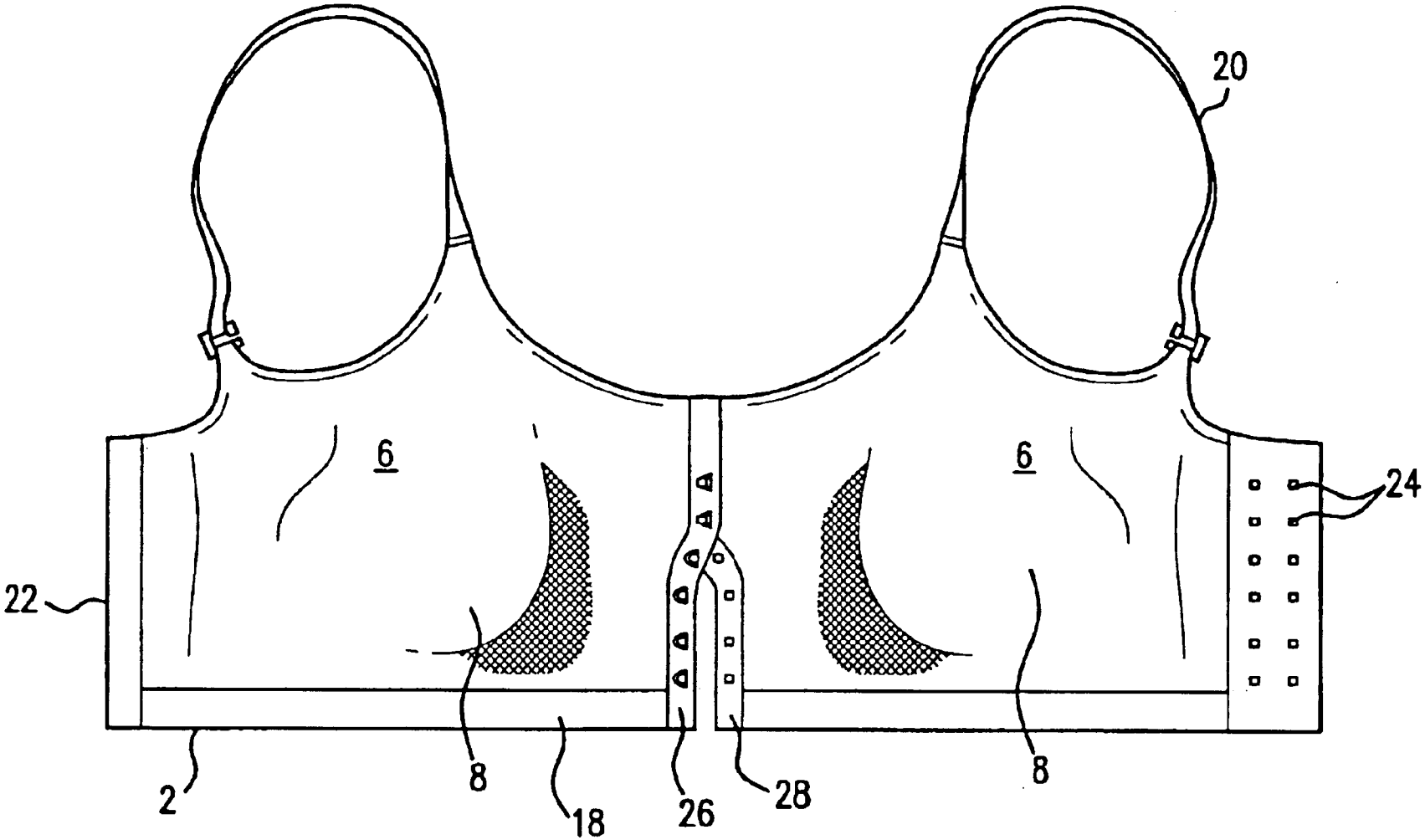
FIG. 3 is a diagram of the outer side of the brassiere of the Invention.
Figure 4:
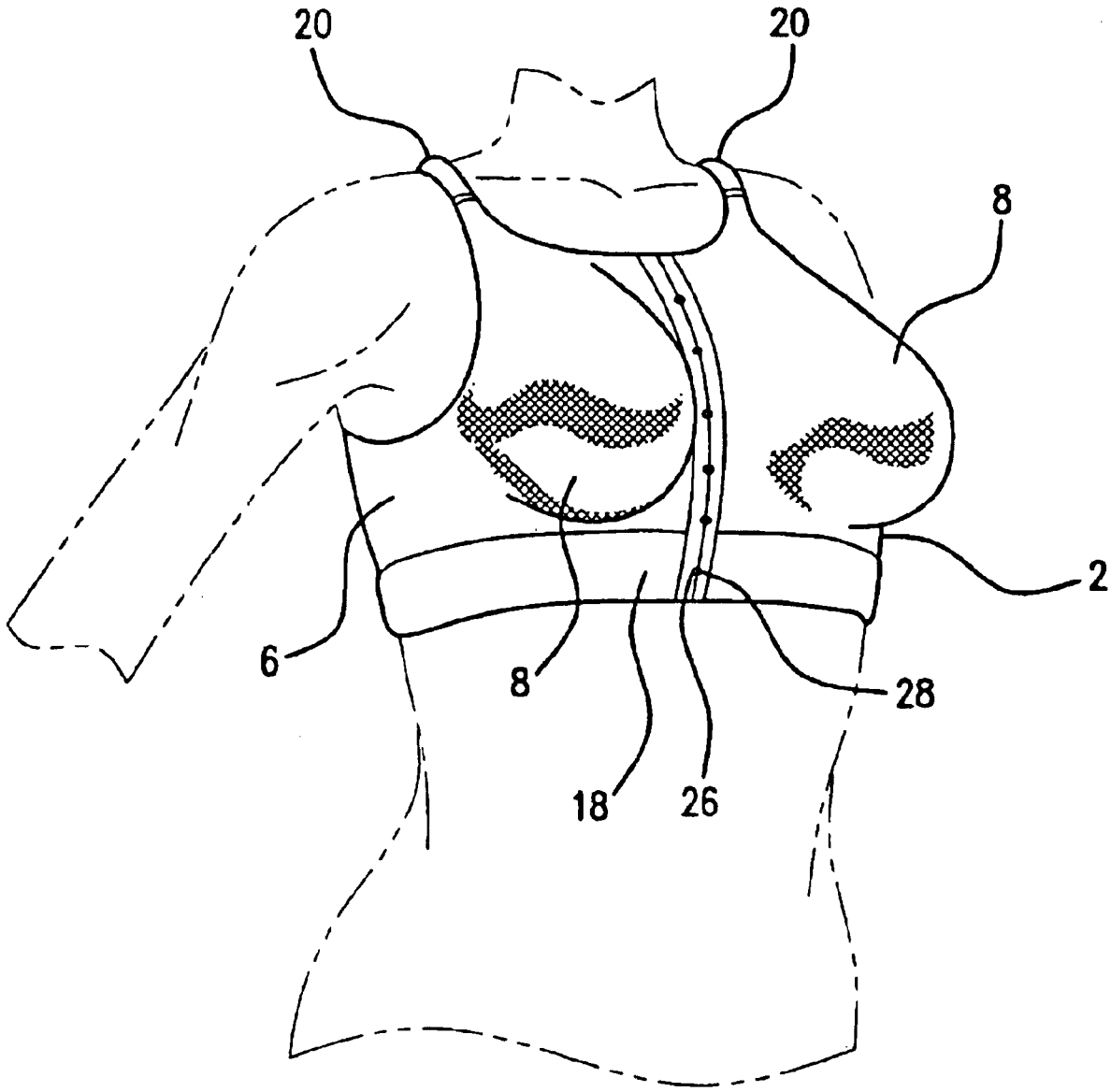
FIG. 4 Is a perspective view of the Invention in use.

As illustrated by FIGS. 1, a brassiere 2 is provided. The brassiere has an inside surface 4, shown by FIG. 1, and an outside surface 6, shown by FIGS. 2, 3 and 4. The inside surface 4 is the portion of the brassiere 2 that touches a woman's skin. The brassiere defines two cups 8 to accept and support the woman's breasts.

Figure 2:
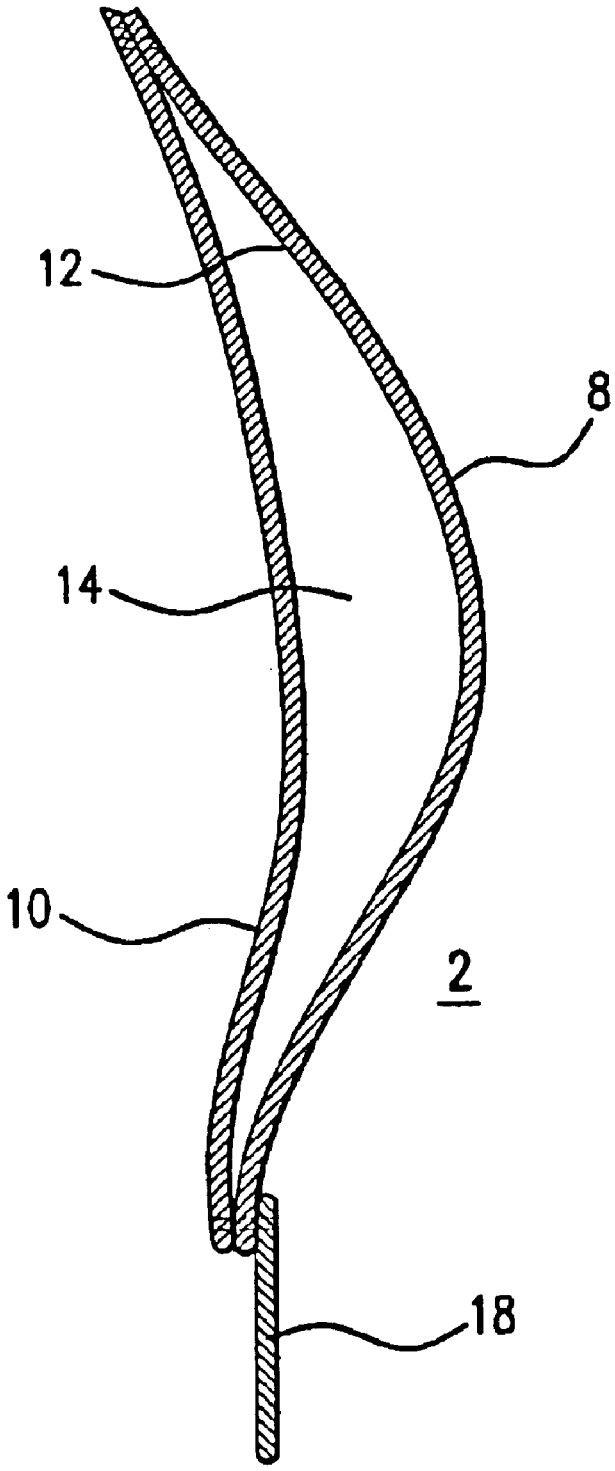
FIG. 2 is cross section A—A from FIG. 1.

Cup liners 10 line the cup inside surface 12, as shown by the cross section view of FIG. 2. In use, cup liners 10 touch the skin of the woman's breast area, including any surgical incisions that may exist resulting from breast surgery. Cup liners 10 and cups 8 define two pockets 14 to receive breast prostheses 16. Brassiere 2 may be used with or without breast prostheses 16, as required by the wearer. An elastic band 18 provides support from below and prevents slippage of prostheses 16. Shoulder straps 20 provide support from above.

Rear hooks 22 engage corresponding rear eyes 24 to fasten the brassiere 2 securely around the back of the woman. Multiple rows of rear eyes 24 are provided to allow adjustment of brassiere 2 to accommodate a range of sizes and to apply an appropriate tension to the elastic band 18.

Front hooks 26 engage corresponding front eyes 28 to allow a woman to easily put on or take off the brassiere 2. Front entry and exit from the brassiere may be particularly important to a woman who has impaired arm movement or strength as a result of breast surgery. Pad 30 protects the woman's skin from abrasion by the front hooks 26 and front eyes 28.

Cup liner 10 is composed of yarn that incorporates synthetic fibers 32 containing silver sodium hydrogen zirconium phosphate, a ceramic ion-exchange resin. The silver-containing resin is a fine powder with a particle size of approximately 1.3 microns. The silver-containing resin is compounded with other resins and spun as a synthetic fiber. Different formulations of silver-containing resin may be used, including formulations having 10% by weight of silver ion, 3.8% of silver ion or 3.1% by weight of silver ion combined with 69% by weight of zinc oxide. The silver-containing resin may be spun into fibers containing up to 2% silver sodium hydrogen zirconium phosphate by weight. A suitable silver sodium hydrogen zirconium phosphate resin is AlphaSan™ available from Milliken Chemical.

The silver-containing resin may be incorporated into polyester, nylon or acetate fibers. The silver sodium hydrogen zirconium phosphate resins are tolerant of high temperatures and may be spun into fibers using heat as a part of the production process. A suitable fabric is style number 2207 manufactured by Ultimair Corporation of Lumberton, N.C.

In Use, silver Ions are released slowly from the fibers of the cup liner 10 through ion exchange. The release of the silver ions Is slow enough that the fiber retains its antimicrobial properties for the life of the brassiere 2. The silver sodium hydrogen zirconium phosphate resin has very low toxicity to people and is safe for skin contact.

The yarns including silver-containing fibers 32 may be formulated to allow even dying of the yarn, so that brassieres of any color may be created, as desired.

Figure 5:
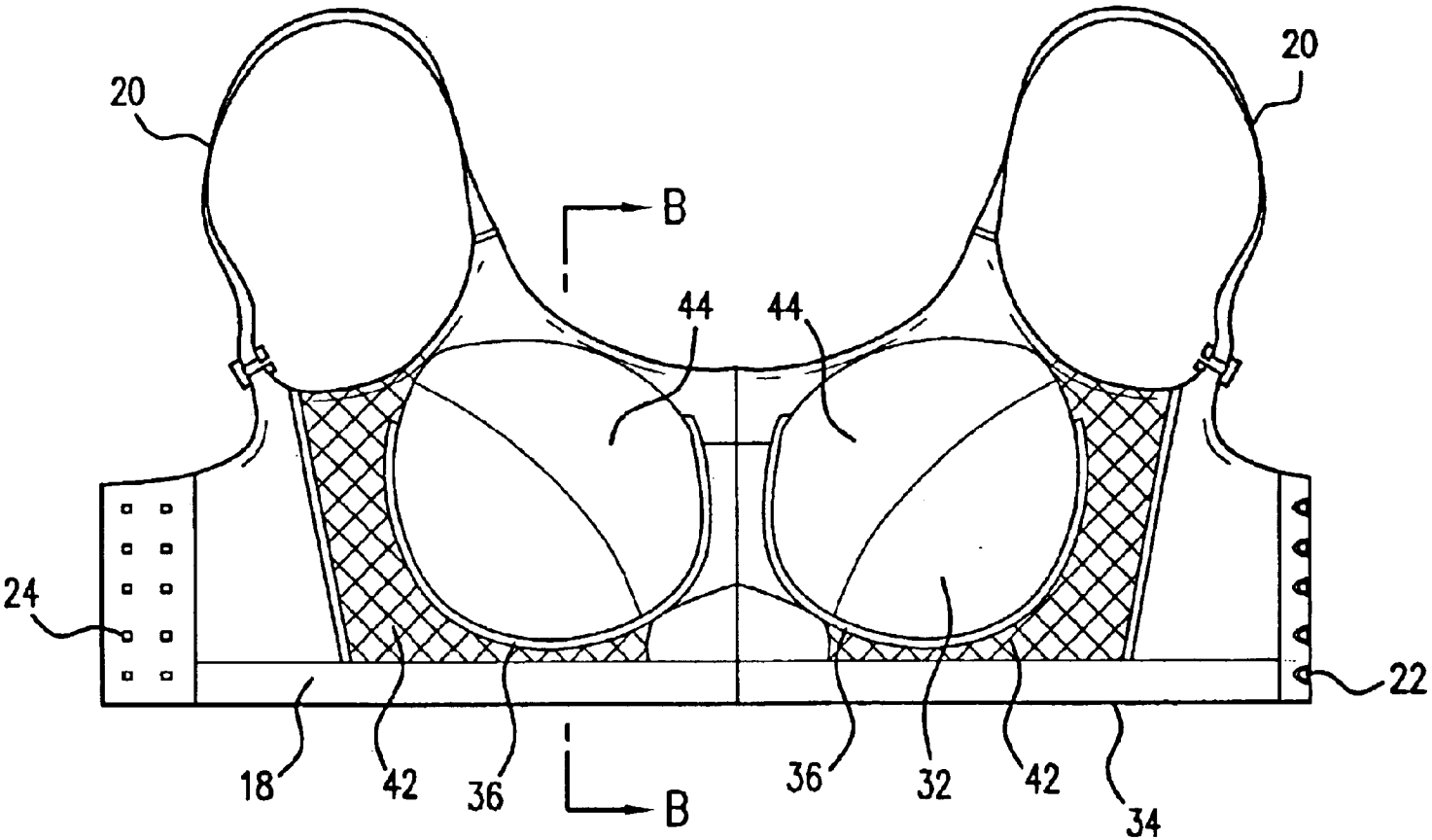
FIG. 5 is a diagram of the inner side of an alternative embodiment brassiere.
Figure 6:
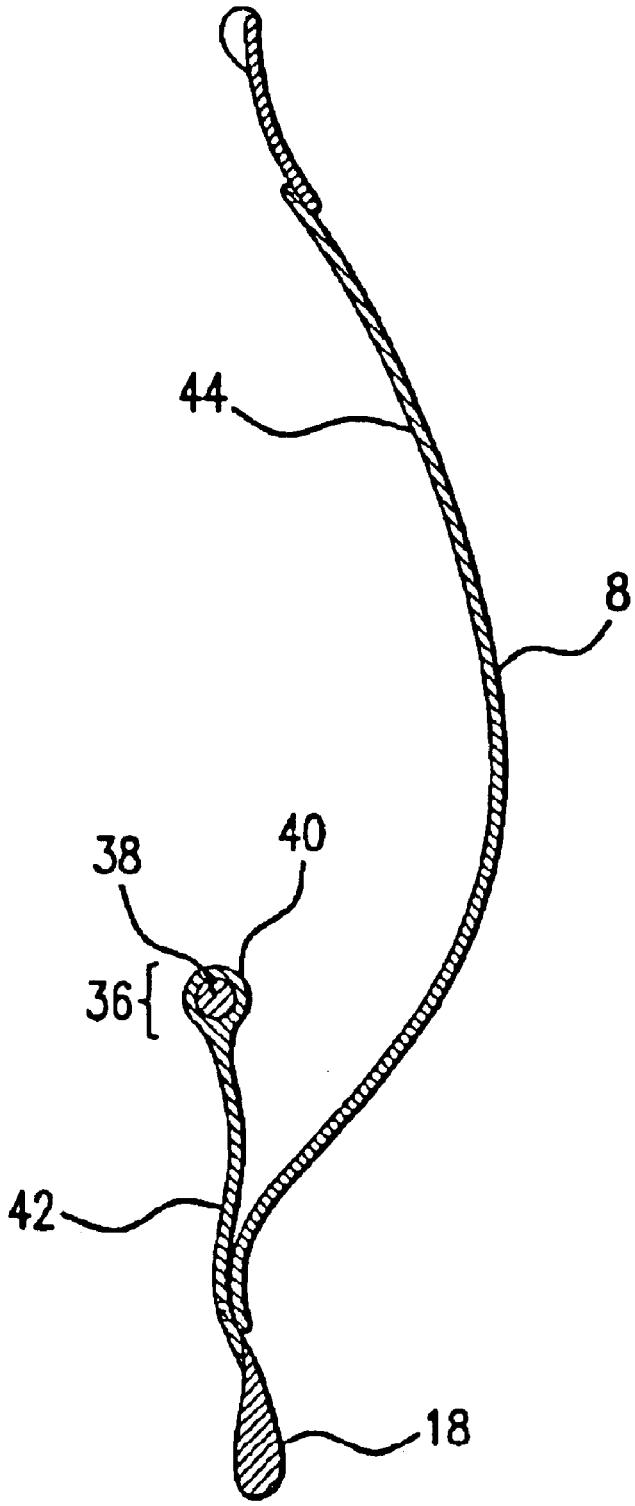
FIG. 6 is cross section B—B from FIG. 5.

FIG. 5 illustrates an alternative embodiment minimizing brassiere 34 to be worn by a woman after breast surgery. FIG. 5 illustrates the side of the alternative brassiere 34 that will touch the woman's skin. The alternative embodiment brassiere 34 is intended to be worn by the woman after incisions from the surgery have healed. The alternative brassiere 34 includes two underwire assemblies 36 in a floating frame configuration to support the woman's breasts. As shown by the cross section view of FIG. 6, each underwire assembly 36 comprises a wire 38 and a fabric covering 40 for the wire 38 to prevent contact between the wire 38 and the woman's skin. In the floating frame configuration, the underwire assemblies 36 are attached to support panels 42 (indicated by cross hatching on FIG. 5). Support panels 42 and underwire assemblies 36 cooperate with cups 8 to receive the woman's breasts.

In use, support panels 42 and underwire assemblies 36 lie between the woman's breasts and the woman's chest. As a result, the underwire assemblies 36 and support panels 42 have little ventilation when worn and present a warm, humid environment where microbes may proliferate. The alternative embodiment cup inside surface 44 of the cups 8 and support panel 42 of the alternative embodiment brassiere 34 are created from fabrics that incorporate fibers 32 containing silver sodium hydrogen zirconium phosphate, as described above. The silver ions of the silver sodium hydrogen zirconium phosphate serve to inhibit microbe growth on the alternative embodiment brassiere 34.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

I claim:

1. A brassiere comprising:

a. two cups, each cup having an inner surface;

b. an elastic band attached to each of said cups and securing said cups to a torso of a wearer;

c. two cup liners, one of said cup liners being attached to one of said inner surfaces of one of said cups, the other said cup liner being attached to the other said inner surface of the other of said cups;

d. an antimicrobial fiber, each of said cup liners comprising said antimicrobial fiber, said antimicrobial fiber contacting a skin of a breast area of said wearer, said antimicrobial fiber thereby controlling microbes on said skin of said breast area of said wearer.

2. The brassiere of claim 1 wherein said antimicrobial fiber is a synthetic fiber comprising a synthetic fiber resin compounded with a silver sodium hydrogen zirconium phosphate resin, said silver sodium hydrogen zirconium phosphate resin being present in said antimicrobial fiber in an amount sufficient to exert an antimicrobial effect on said skin of said breast area of said wearer.

3. The brassiere of claim 2 wherein said silver sodium hydrogen zirconium phosphate resin comprises 2% or less by weight of said fiber and the balance of said fiber being selected from the group consisting of polyester, nylon and acetate.

4. The brassiere of claim 3 wherein 10% by weight of said silver sodium hydrogen zirconium phosphate resin consists of silver.

5. The brassiere of claim 3 wherein 3.8% by weight of said silver sodium hydrogen zirconium phosphate resin consists of silver.

6. The brassiere of claim 3 wherein 3.1% by weight of said silver sodium hydrogen zirconium phosphate resin consists of silver.

7. The brassiere of claim 3 further comprising:

a. two shoulder straps, one of said shoulder straps being attached to one of said cups and passing over a shoulder of said wearer, the other of said shoulder straps being attached to the other of said cups and passing over another shoulder of said wearer;

b. two pockets, each pocket being defined by one of said cup liners and one of said interior surfaces of said cups, each of said pockets being adapted to receive a prosthesis.

8. The brassiere of claim 7 wherein said cups are detachable one from the other to allow front opening, said brassiere further comprising:

a. a plurality of front hooks attached to one of said cups;

b. a plurality of front loops attached to the other of said cups, said hooks and said loops adapted to engage one with the other, said hooks and said loops thereby releasably engaging one cup to the other;

c. a pad appearing on an inside surface of said brassiere, said pad disposed between said front hooks and said skin of said wearer to prevent contact between said front hooks and said front loops and said skin of said wearer.

9. A brassiere, the brassiere comprising:

a. two cups, each of said cups having an inside surface;

b. an elastic strap, said elastic strap securing said cups to a torso of a wearer;

c. each of said inside surfaces of said cups comprising an antimicrobial fiber, said antimicrobial fiber being held in contact with a skin of a breast area of said wearer by said cups and said elastic strap.

10. The brassiere of claim 9 wherein said antimicrobial fiber is a synthetic fiber comprising a synthetic fiber resin compounded with a silver sodium hydrogen zirconium phosphate resin, said silver sodium hydrogen zirconium phosphate resin being present in said antimicrobial fiber in an amount sufficient to exert an antimicrobial effect on said skin of said breast area of said wearer.

11. The brassiere of claim 10 wherein said silver sodium hydrogen zirconium phosphate resin comprises 2% or less by weight of said fiber and the balance of said fiber being selected from the group consisting of polyester, nylon and acetate.

12. The brassiere of claim 11 wherein 10% by weight of said silver sodium hydrogen zirconium phosphate resin consists of silver.

13. The brassiere of claim 11 wherein 3.8% by weight of said silver sodium hydrogen zirconium phosphate resin consists of silver.

14. The brassiere of claim 11 wherein 3.1% by weight of said silver sodium hydrogen zirconium phosphate resin consists of silver.

15. The brassiere of claim 14 further comprising:

a. two support panels, one of said support panels being attached to one of said cups and the other of said support panels being attached to the other of said cups;

b. two underwire assemblies, one of said underwire assemblies being attached to one of said support panels and the other of said underwire assemblies being attached to the other of said support panels.

16. The brassiere of claim 15 wherein said support panels comprise said antimicrobial fiber.

* * * * *